US008061644B1

(12) United States Patent
Dion

(10) Patent No.: US 8,061,644 B1
(45) Date of Patent: Nov. 22, 2011

(54) INCREMENTALLY ADJUSTABLE LEVEL WINDING MECHANISM

(75) Inventor: Dennis Dion, Spring, TX (US)

(73) Assignee: PATCO Machine & Fab., Inc., Houston, TX (US)

( * ) Notice: Subject to any disclaimer, the term of this patent is extended or adjusted under 35 U.S.C. 154(b) by 0 days.

(21) Appl. No.: 13/005,044

(22) Filed: Jan. 12, 2011

(51) Int. Cl.
*B65H 57/00* (2006.01)

(52) U.S. Cl. ..... 242/397.3; 242/157.1

(58) Field of Classification Search ..... 242/397, 242/397.2, 397.3, 482.4, 483.3, 483.4, 157.1; 248/49; 403/98, 87, 92, 116, 161; 211/44, 211/85.22, 194
See application file for complete search history.

(56) References Cited

U.S. PATENT DOCUMENTS 3,614,019 A * 10/1971 Slator et al. ..... 242/157.1
4,410,297 A * 10/1983 Lynch ..... 242/397.3
4,767,073 A 8/1988 Malzacher
5,950,953 A 9/1999 Baugh et al.
6,012,684 A * 1/2000 Umney et al. ..... 248/65
7,150,425 B2 * 12/2006 Banaszkiewicz et al. . 242/397.2
7,210,647 B2 5/2007 Dion
7,363,968 B1 * 4/2008 Baugh ..... 242/157.1
7,669,795 B2 * 3/2010 Brown ..... 242/397
2006/0273213 A1 * 12/2006 Turk et al. ..... 242/397.3

OTHER PUBLICATIONS

Six Photographs, PATCO Atlantis IWOCS Reel.
Dynacon, Inc. Winch Handling System, Offshore Source Newsletter, Jul. 2005, p. 23, vol. 7, issue 7, Technology Systems Corporation, Palm City, FL, US.
Two Photographs, Deepsea-Tech Reel.
One Photograph, Dynacon Reel.

* cited by examiner

*Primary Examiner* — William A Rivera
(74) *Attorney, Agent, or Firm* — Beem Patent Law Firm

(57) ABSTRACT

A reel having an adjustable deployment angle including a frame, a drum mounted in the frame and having a core and end flanges, a level wind assembly having a carriage, a lead screw and an indexing finger or fingers, and a guide frame element or elements coupled to the frame proximate one of the end flanges, wherein the guide frame element includes a groove having a plurality of discrete, preferably linear, segments configured to receive the indexing finger. Additionally, the groove may include a generally radially-inwardly extending notch at an intersection of each of the discrete segments, where each of the notches may be radially spaced a different distance from an axis of rotation of the drum. Adjusting the level wind assembly may include moving the indexing finger out of a notch, along one or more of the discrete segments, and back into a second notch.

20 Claims, 6 Drawing Sheets

INCREMENTALLY ADJUSTABLE LEVEL WINDING MECHANISM

BACKGROUND OF THE INVENTION

1. Field of the Invention

This invention relates to spooling systems for the receiving, storage, and deploying of cables, hoses, umbilical connections, such as bundles of hydraulic lines or hydraulic and electrical lines and the like, i.e., collectively "cables."

Present systems for winding cable onto spools, particularly on off-shore drill rigs, employ spools which are mechanically driven. Offshore drilling systems have reels with various capacities outside diameter cable for controlling of subsea blowout prevention equipment.

2. Description of the Related Art

One such cable spooling system is disclosed in U.S. Pat. No. 4,767,073. With this type of system, as the cable is wound onto or off of the spool it is guided by a cable guide or "level wind" assembly mounted for traversing a reversible diamond groove shaft parallel to the axis of the spool. The cable guide assembly is coupled to tracking guide bars. Thus, the cable guide assembly traverses the diamond groove shaft and guide bars from one side to the other, evenly distributing the cable on the hub of the spool. When the cable gets to one end of the diamond groove shaft, it automatically reverses and continues to traverse in the other direction, continuously feeding the cable onto the spool. Many reels have been manufactured with this familiar diamond pattern lead screw mechanism to cause the line being wound onto the drum of the reel to be wrapped in an orderly and compact fashion. Probably the most common of these is the fishing reel.

In some instances, the level wind assembly may be fixed to the frame so that a single, constant deployment angle is available. This configuration may be good for repetitive uses where no change to the angle may be necessary once the system is installed or where the system is installed once and then never moved.

Alternatively, it may be desirable to adjust the level wind assembly about the reel in order to change the deployment angle. One example of an adjustable level wind assembly may be seen in U.S. Pat. No. 5,950,953, in which the level wind assembly includes a carriage traversable on an upper guide bar and a diamond groove shaft that are mounted to plates at each end. The end plates are rotatable about the axis of rotation of the drum, so that they move in a circumferential arc to allow adjustment of the assembly.

SUMMARY OF THE INVENTION

In one aspect, a reel having an adjustable deployment angle may comprise a frame, a drum mounted in the frame and having a core and end flanges, a level wind assembly having a carriage, a lead screw and an indexing finger or fingers, and a guide frame element or elements coupled to the frame proximate one of the end flanges, wherein the guide frame element includes a groove having a plurality of discrete segments configured to receive the indexing finger. The discrete groove segments may take various shapes, but they preferably are linear. Additionally, the groove may include a generally radially-inwardly extending notch at an intersection of each of the discrete segments, where each of the notches may be radially spaced a different distance from an axis of rotation of the drum.

The level wind assembly further may include an end bracket having a plurality of openings, and the guide frame element may include a plurality of flanges extending inward from the plurality of discrete segments, each of the flanges including a plurality of openings, such that the openings in the bracket may be configured to align with the openings in each of the flanges, and the openings in the bracket and flanges are configured to receive a plurality of fasteners to secure the level wind assembly at a desired position along the guide frame element.

In another aspect, a reel having an adjustable deployment angle may include a frame, a drum mounted in the frame and having a core and end flanges, a level wind assembly having a carriage, a lead screw and a plurality of indexing fingers, and a plurality of guide frame elements. At least one guide frame element may be coupled to the frame proximate one end flange and at least a second guide frame element may be coupled to the frame proximate a second end flange. In addition, each of the guide frame elements may include a groove having a plurality of discrete segments and notches between the discrete segments that are configured to receive the indexing fingers. Moreover, each of the guide frame elements further may include a plurality of discrete flanges substantially aligned with the discrete groove segments, and a pair of the guide frame elements may be substantially mirror images of one another. Further, for each of the guide frame elements, each of said notches is radially spaced a different distance from an axis of rotation of said drum.

The level wind assembly includes a plurality of first openings and at least one of the discrete flanges includes a plurality of second openings, wherein the plurality of first openings align with the plurality of second openings, and further wherein, when aligned, the first and second openings are configured to receive fasteners to secure the level wind assembly to the guide frame element.

Each groove may comprise between about 3 and about 10 discrete segments, preferably between about 5 and about 7 discrete segments. Additionally, the assembly may include at least one discrete flange not substantially aligned with a discrete segment of the groove. To adjust the deployment angle, each of the indexing fingers may move out of a notch, away from an axis of rotation of the drum, along one or more discrete segments, and into another notch, toward the axis of rotation of the drum.

In still another aspect, a guide frame element coupleable to a frame for adjusting a deployment angle may include a generally planar plate, a groove extending at least partially through the plate, the groove comprising a series of discrete segments, a plurality of notches, each notch extending generally radially inwardly between a respective pair of discrete segments, and a plurality of discrete flanges, each flange substantially aligned with a respective discrete segment of the groove. Each flange may substantially span a distance between a respective pair of notches. Moreover, the guide frame element may include at least one additional flange not substantially aligned with a respective discrete groove segment.

The discrete segments and discrete flanges may be substantially linear. Additionally, the discrete flanges may be disposed on a same side of the plate as an entrance to the groove and also may be disposed proximate a radially inward groove edge. The radially inward groove edge may be interrupted by the notches, but the radially outward groove edge may be substantially uninterrupted.

These and other features and advantages are evident from the following description of the present invention, with reference to the accompanying drawings.

DETAILED DESCRIPTION

Figure 1:
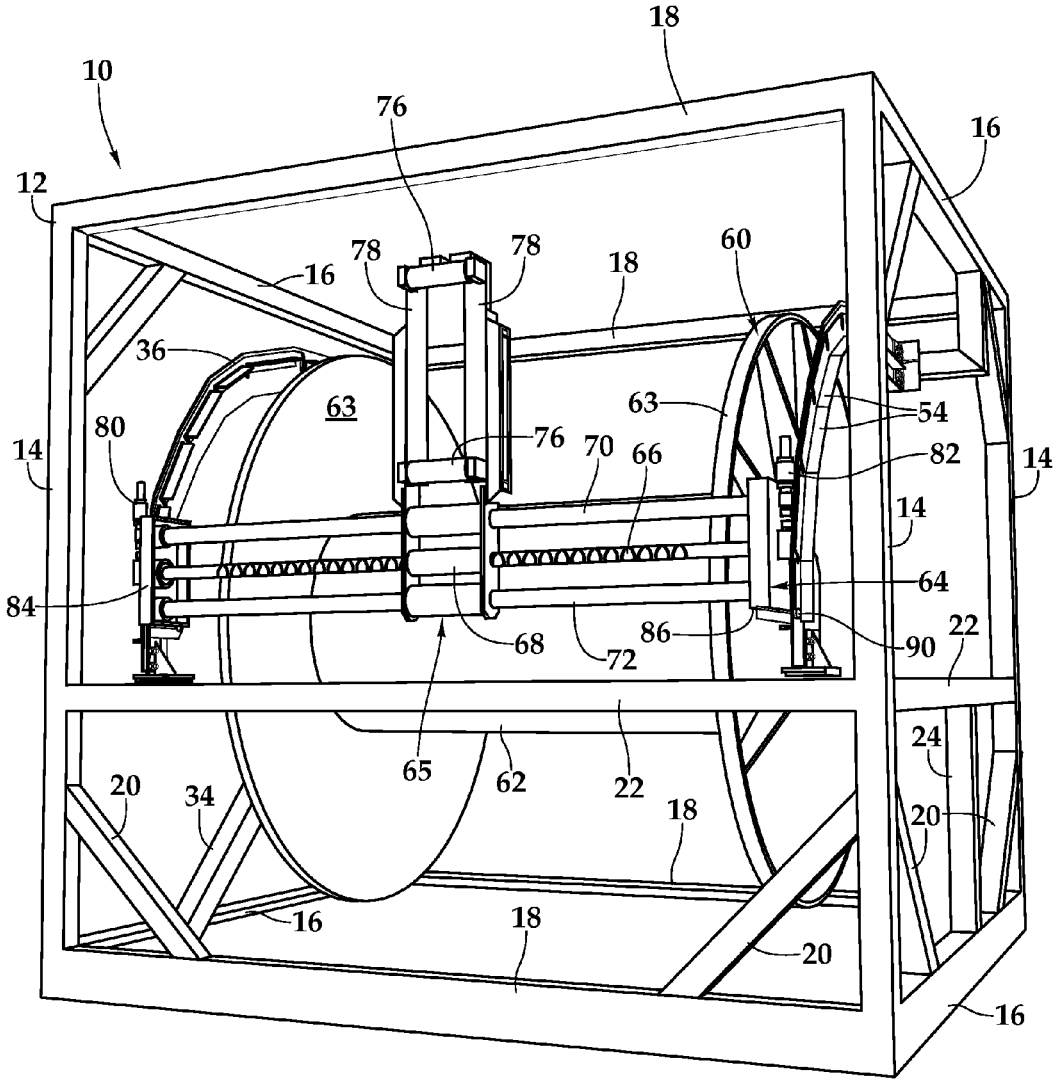
FIG. 1 is a front perspective view of a cable spooling system having an adjustable level wind assembly.
Figure 2:
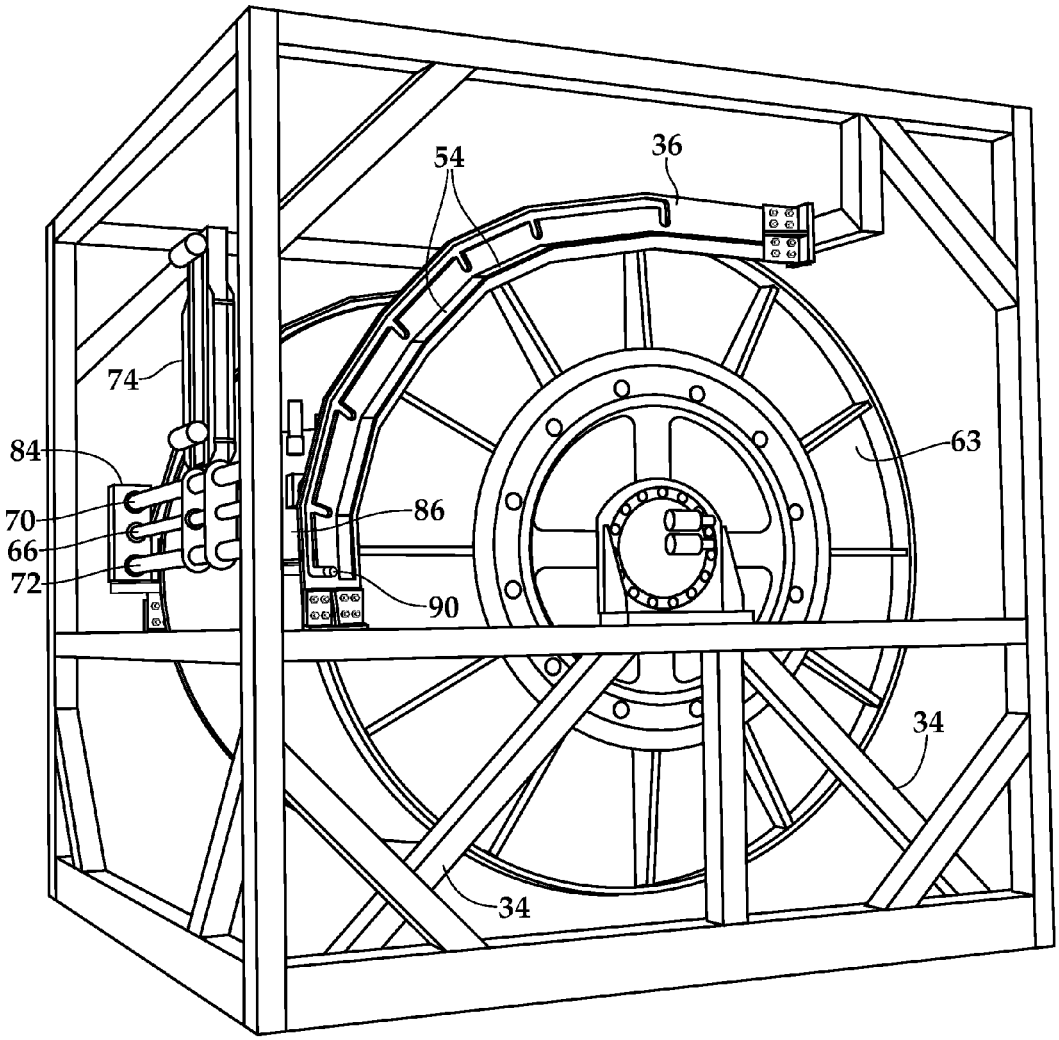
FIG. 2 is a side perspective view of the cable spooling system of FIG. 1.

The cable spooling system or reel assembly 10 is shown generally in FIGS. 1-8, and comprises a frame 12 that rotatably supports a cable spool 60 via drum supporting members 34, the spool 60 having a core or hub 62 and opposite end flanges 63. A cable, wire, hose, etc. (not shown) is guided onto and off of the spool for even wrapping by means of a cable guide or "level wind" assembly 64 having a carriage 65 mounted for traversing a reversible diamond groove shaft 66 by means of a follower 68, as the shaft 66 is rotated. As discussed below, the reel assembly 10 may include one or more guide frame elements 36 that allow the level wind assembly 64 to be moved to a plurality of different positions in order to change the angle the cable makes when exiting frame 12.

Frame 12 may include a plurality of vertical end frame members 14, horizontal end frame members 16, and cross members 18. Frame also may include a plurality of corner braces 20, such as braces 20 connecting vertical end members 14 to horizontal end members 16 or to cross members 18.

Frame 12 further may include one or more intermediate, horizontal braces 22, preferably a plurality of braces 22, around a perimeter of frame 12. Horizontal braces 22 may be located proximate a height of the center/axis of rotation of spool 60, preferably slightly below center of spool 60. Additionally, frame 12 may include one or more intermediate, vertical frame braces 24 connecting horizontal end frame members 16 to intermediate, horizontal braces 22.

Reel assembly 10 may include one or more guide frame weldments or elements 36 coupled to frame 12, e.g., via a first bracket 26 and a second bracket 28. Brackets 26, 28 may be coupled to frame 12, such as by welding or fastening. For example, bracket 26 may be directly or indirectly coupled to and extend upward from intermediate, horizontal brace 22 at a location generally aligned with an outer radial distance of end flange 63 of spool 60. Similarly, bracket 28 may be coupled, directly or indirectly, to upper horizontal end frame member 16. As with bracket 26, bracket 28 may be at a location generally aligned with an outer radial distance of end flange 63, i.e., generally along a tangent to the edge of flange 63, although one or both of brackets 26, 28 may be located radially inward or outward of the outer radial distance of flange 63 and also may be located at different radial distances from each other. Additionally, bracket locations may be of secondary importance in relationship to the location of groove 44 on guide frame element 36, as discussed below.

First bracket 26 may include a first plurality of openings 30, and second bracket 28 may include a second plurality of openings 32. Openings 30, 32 may align with similar openings 40, 42 on guide frame element 36, and each of these openings may be configured to receive a bolt, rivet, screw, or other type of fastener for fixedly or releasably coupling guide frame element 36 to frame 12.

In one embodiment, reel assembly 10 may include a single guide frame element 36 disposed proximate one end flange 63 of spool 60. Preferably, however, reel assembly 10 includes a plurality of guide frame elements 36, such as a pair of elements 36, with one element disposed proximate each end flange 63 of spool 60. In addition, while guide frame elements may be different from one another, preferably, they may be substantial mirror-images. As such, one guide frame element 36 is described below with the understanding that additional guide frame elements may be substantially similar.

Figure 3:
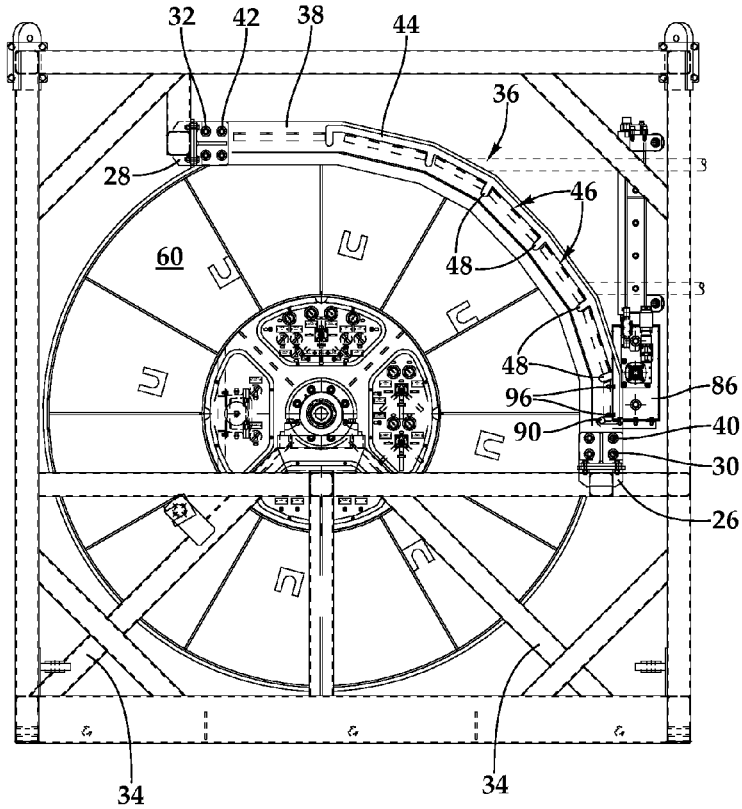
FIG. 3 is a left side view of the spooling system of FIG. 1 showing the level wind assembly in a first position.
Figure 4:
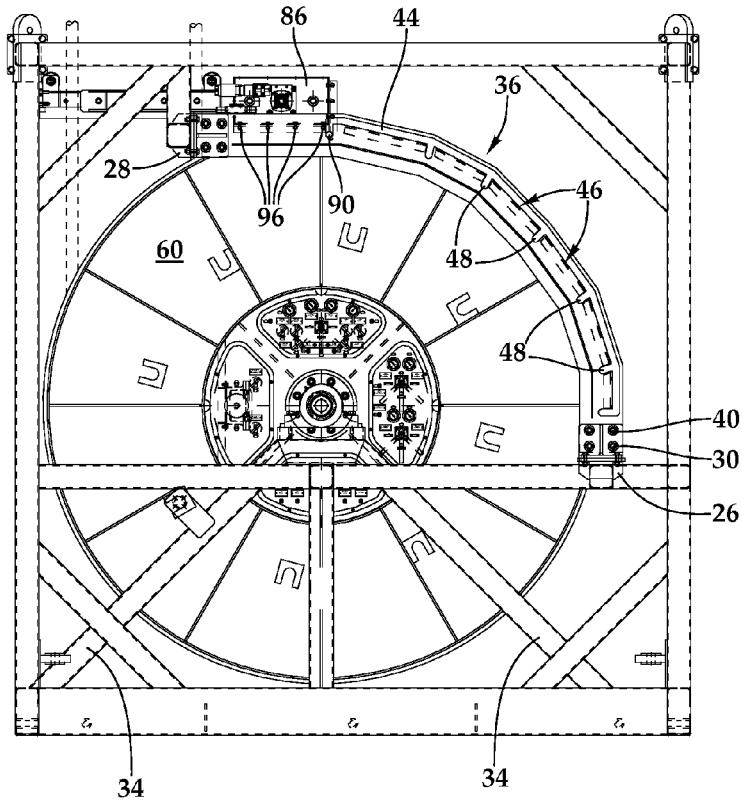
FIG. 4 is a left side view of the spooling system of FIG. 1 showing the level wind assembly in a second position.

Turning to FIGS. 3-4, guide frame element 36 may include a generally planar plate 38 that includes a groove 44. Groove 44 may extend partially or completely through a thickness of plate 38. In addition, groove 44 may comprise a series of discrete, substantially linear or completely linear segments 46 joined end-to-end. Groove 44 further may include a plurality of radially inwardly extending notches 48. Groove 44 may have a substantially continuous outer edge, while inner edge of groove 44 may be interrupted at one or more locations by notches 48.

There may be a notch at each end of groove 44 and additional notches along the length of groove 44. As seen in FIGS. 3-4 and 9-11, notches 48 may be located proximate the intersections of each of the linear segments 46, although additional or alternative notches may be located along the length of one or more linear segments 46, i.e., at some point between the intersections.

Figure 5:
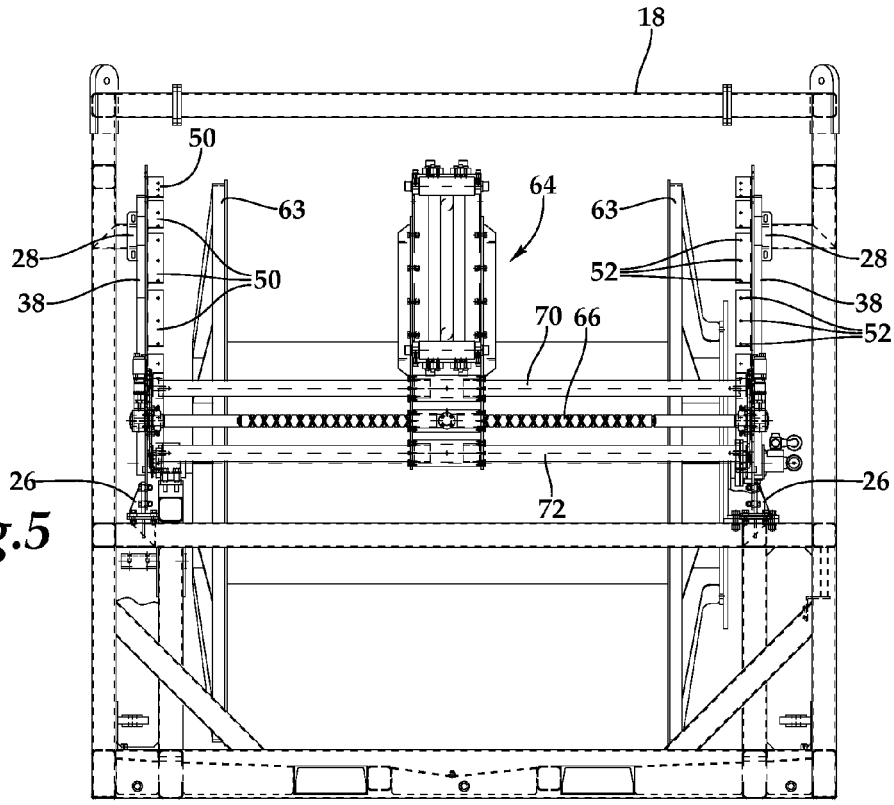
FIG. 5 is a front view of the spooling system of FIG. 1 showing the level wind assembly in the first position.
Figure 6:
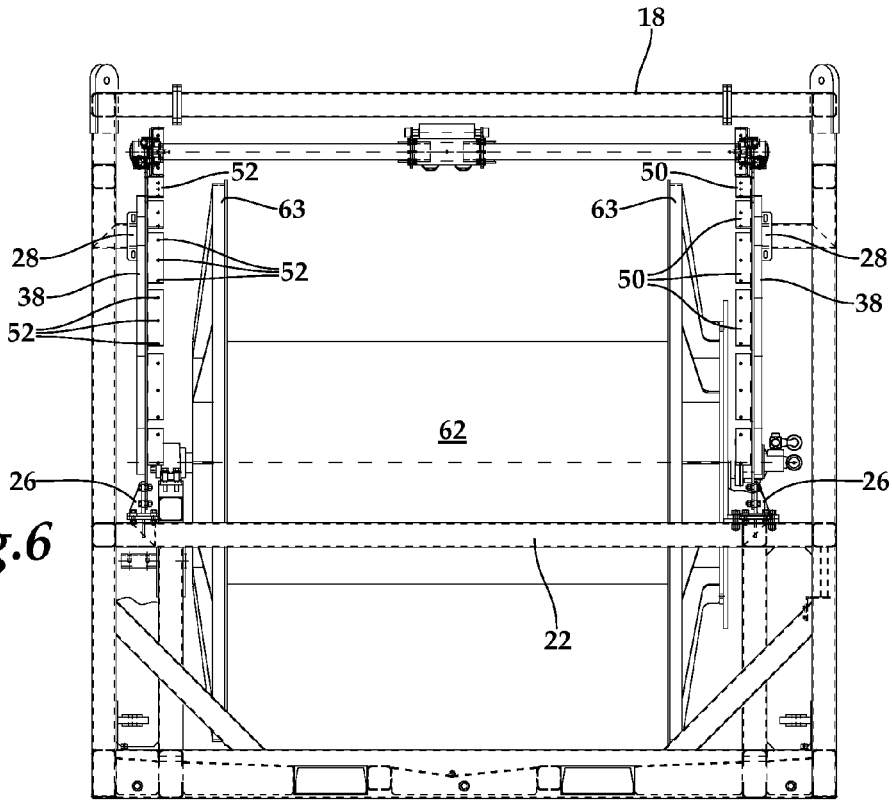
FIG. 6 is a front view of the spooling system of FIG. 1 showing the level wind assembly in the second position.
Figure 7:
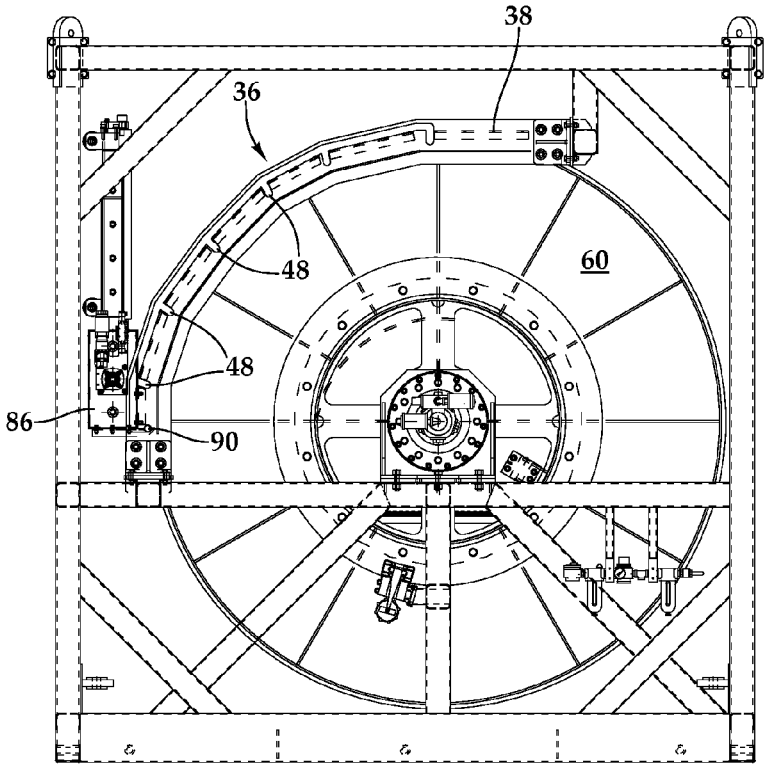
FIG. 7 is a right side view of the spooling system of FIG. 1 showing the level wind assembly in the first position.
Figure 8:
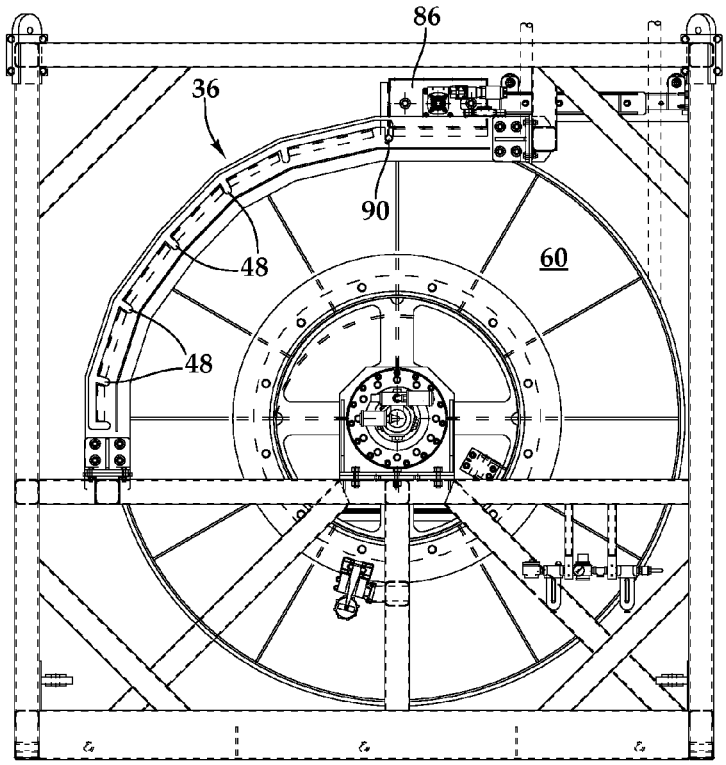
FIG. 8 is a right side view of the spooling system of FIG. 1 showing the level wind assembly in the second position.
Figure 9:
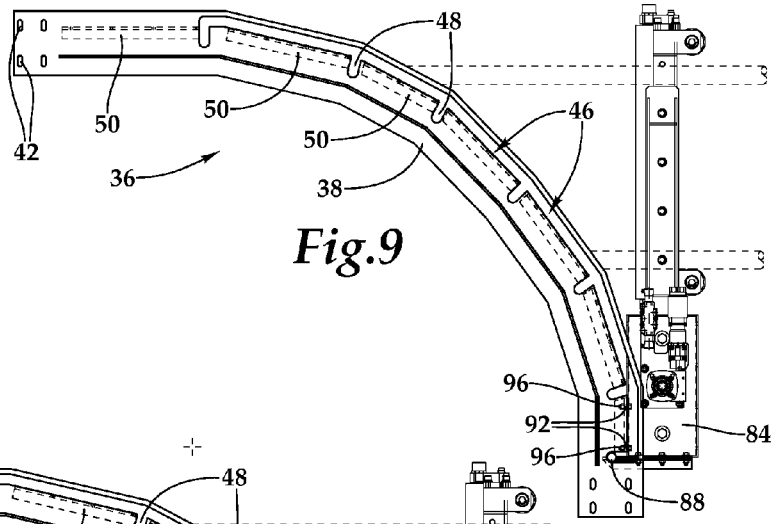
FIG. 9 is a side view of a guide frame element and a level wind assembly with the level wind assembly in a first position.
Figure 10:
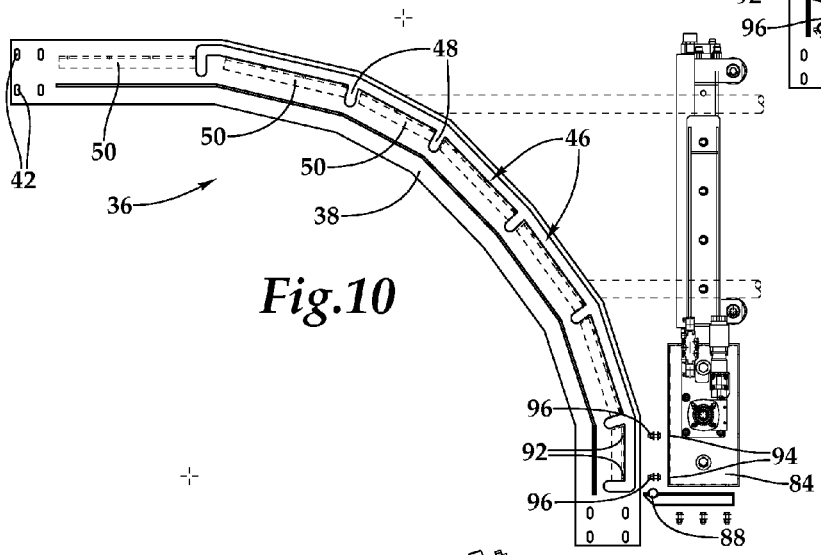
FIG. 10 is a side view of the guide frame element and level wind assembly of FIG. 9 with the level wind assembly exploded.
Figure 11:
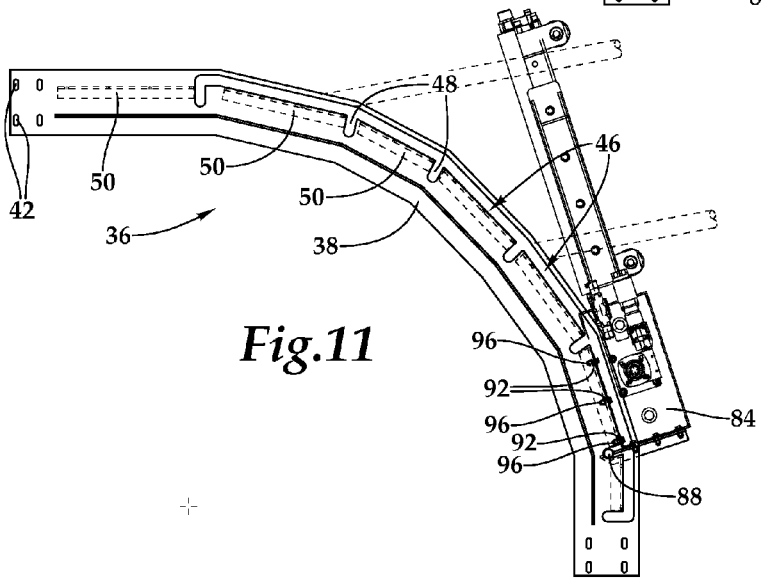
FIG. 11 is a side view of the guide frame element and level wind assembly of FIG. 9 with the level wind assembly in a second position.

Turning to FIGS. 5-6, plate 38 may include a plurality of openings 40 proximate a first end and a second plurality of openings 42 proximate a second end. As discussed above, openings 40, 42 may be configured to receive fasteners to couple plate 38 to the rest of frame 12. End brackets 84, 86 of level wind assembly 64 may couple to and/or rest on flanges 50, such that groove 44 and flanges 50 may begin proximate openings 40, while providing adequate clearance for end brackets 84, 86. Conversely, guide frame element 36 may include an additional flange 50 extending along plate 38 beyond an end of groove 44. Openings 42, therefore, may be spaced a sufficient distance from the end of groove 44 to provide room for this last flange 50 and to ensure adequate clearance for end brackets 84, 86.

Guide frame element 36 also may include a plurality of flanges 50 that substantially track the path of groove 44. Flanges 50 may be disposed inward from plate 38, i.e., closer to end flanges 63 of spool 60 than plate 38 is. Flanges 50 may be substantially aligned with linear segments 46 of groove 44 and also may be located proximate the inner edge segments of groove 44. Each flange 50 may include a plurality of openings 52 extending through flange 50, substantially perpendicular to linear segments 46 of groove 44. Openings 52 may align with openings 92, 94 in one or both of end brackets 84, 86 of level wind assembly 64, and openings 52, 92, 94 may be configured to receive fasteners 96 for removably coupling level wind assembly 64 at one of a plurality of positions about spool 60.

Linear segments 46 of groove may be similar or may vary in length with respect to other segments. Additionally, angles formed between successive linear segments 46 may be similar or may vary from intersection to intersection. As such, it is possible to vary the radial distance to each notch 48 and to each series of openings 52 in each flange 50.

Returning to FIGS. 1-2, guide frame elements 36 may include one or more stiffeners 54, which may add additional rigidity to elements 36. Although stiffeners may take various shapes and/or sizes, in the embodiment shown, stiffeners 54 may comprise one or more substantially planar flanges extending along element 36. Stiffeners 54 may be disposed on a side of element 36 opposite from flanges 50. Stiffeners may abut one another or form a generally continuous path from one stiffener to the next, although discrete, separated stiffeners also may be used.

Level wind assembly 64 may include one or more end brackets 84, 86 at opposing ends. As described below, end brackets 84, 86 may support one or more of diamond groove shaft 66 and tracking guide bars 70, 72. Brackets 84, 86 also may support one or more outwardly extending indexing fingers 88, 90. Each finger may be configured to fit within a respective groove 44 in order to guide level wind assembly 64 from one position to another. Additionally, one or more wheels, rollers, casters, etc., may be coupled to fingers 88, 90. Wheels may allow fingers 88, 90 to slide more easily within notches 48 and/or segments 46 of groove 44. Although wheels may be offset from fingers, wheels preferably are generally concentric with fingers 88, 90 and may rotatably couple to fingers 88, 90, e.g., by using bearing packs or bushings.

To adjust level wind assembly 64, a crane or other lifting device (not shown) may be coupled to level wind assembly. Fasteners 96 may be removed from openings 52 in flanges 50 and openings 92, 94 in level wind assembly 64 to uncouple level wind assembly 64 from frame 12. With level wind assembly 64 effectively in a "free floating" state, assembly 64 may be moved generally radially away from spool 60, causing indexing fingers 88, 90 to move out of notches 48 and into discrete, linear segments 46 of groove 44. Level wind assembly 64 then may be translated along groove until a desired location is reached, at which point indexing fingers 88, 90 may translate back toward spool 60 into new notches. Openings 92, 94 in level wind assembly 64 may be aligned with openings 52 in flanges 50, and fasteners 96 may be inserted into openings 52, 92, 94 to re-secure level wind assembly 64 to frame 12. Once secured, level wind assembly 64 may be uncoupled from crane or lifting device, which may be stowed for future use, if necessary. In some instances, level wind assembly may be adjusted once and left in that position, e.g., for the life of a project. Other times, it may be preferable or useful to adjust the angle of level wind assembly periodically, e.g., each time the reel is used, depending on the application.

Since the cable passes between rollers 76, 78, altering the angle that level wind assembly 64 makes with respect to the rest of frame 12 allows for adjustment of the angle that cable makes with respect to frame 12. In the embodiment shown in FIGS. 3-8, guide frame element 36 extends around approximately a quarter of the perimeter of spool 60. A first position allows level wind assembly 64 to be mounted generally vertically or generally aligned with end frame member 14, a last position allows level wind assembly 64 to be mounted generally horizontally or generally aligned with end frame member 16, although first and last positions may be modified to accommodate desired cable deployment angles and positions. In addition, between first and last positions, a plurality of intermediate positions allow level wind assembly 64 to be mounted at varying angles with respect to frame 12.

The carriage 65 is coupled to a pair of tracking guide bars 70, 72. The carriage 65 also mounts a frame 74 holding two sets of freely rotating rollers 76, 78 for contacting and guiding the cable. Upper and lower/horizontal rollers 76, and right and left/vertical rollers 78 may be a relatively hard steel material or be coated with resilient materials such as rubber or plastics. Thus, the carriage 65 traverses the diamond groove shaft 66 from one side to the other, evenly distributing the cable on the hub 62 of the spool 60. When the carriage 65 gets to one end of the diamond groove shaft 66, it automatically reverses and continues to traverse in the other direction, continuously feeding the cable onto or off from the spool.

The level wind carriage 65 may be driven in either direction by rotating reversible diamond groove shaft 66. This shaft may be driven by any of the various means known in the art. For example, one or more chains may operatively couple to the shaft 66 to turn it at a speed proportional to rotational speed of spool 60. In this case, a first gear may be coupled to one side of spool 60, and a second gear may be coupled to one end of shaft 66, with a chain operatively coupled to both gears. A similar gear-chain arrangement may appear on the other end of spool 60 and shaft 66.

In one embodiment, chains may be relatively taut on gears. As such, it may be necessary to remove each chain to adjust level wind assembly 64 about frame 12, due to indexing fingers 88, 90 moving radially inward and outward from notches 48 and linearly within discrete segments 46. Alternatively, chains may include sufficient slack to accommodate radial and linear movements of indexing fingers 88, 90 within segments 46 and notches 48 of groove 44, but not sufficient slack to cause slippage of chain on gears.

In yet another embodiment, reel assembly may eliminate the need for chains to drive carriage 65 on shaft 66. As seen in FIG. 1, cable guide assembly 64 may be driven by a pair of air motors 80, 82, one coupled to either end of the diamond groove shaft 66 and powered by the same pneumatic air system which drives the cable spool 60. Details of one form of air motor drive system may be found in the inventor's U.S. Pat. No. 7,210,647, issued May 1, 2007, the contents of which are incorporated herein by reference in their entirety.

A pair of motors 80, 82 may be employed to drive cable guide assembly 64. Alternatively, a single motor 80 may provide sufficient power by itself to drive assembly 64. In the former case, motors 80, 82 may be mounted to end brackets 84, 86 of the cable guide assembly 64, which also may hold opposite ends of the reversible diamond groove shaft 66 and the guide bars 70, 72. In this embodiment, since the level wind system is directly coupled to the spool air drive system, level wind air motors 80 and 82 may provide a proportionally variable speed control to increase or decrease the speed of the reversible diamond groove shaft 66 of the level wind system with variations in the speed of the cable spool. Moreover, since the motors 80 and 82 may be controlled by the same control circuit, they may be maintained "in synch," thereby avoiding any uneven or unequal drive of the two ends of the reversible diamond groove shaft 66.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

I claim:

1. A reel having an adjustable deployment angle, comprising:

a frame;

a drum mounted in said frame and having a core and end flanges;

a level wind assembly having a carriage, a lead screw, and an indexing finger; and a guide frame element coupled to said frame proximate one of said end flanges;

wherein said guide frame element includes a groove having a plurality of discrete, substantially linear segments disposed end-to-end and configured to receive said indexing finger.

2. A reel according to claim 1, wherein said discrete segments are linear.

3. A reel according to claim 1, further comprising a plurality of indexing fingers and a plurality of guide frame elements.

4. A reel according to claim 1, said level wind assembly further including an end bracket having a plurality of openings;

said guide frame element further including a plurality of flanges extending inward from said plurality of discrete segments, each of said flanges including a plurality of openings;

wherein said openings in said bracket are configured to align with said openings in each of said flanges;

and further wherein said openings in said bracket and said flanges are configured to receive a plurality of fasteners to secure said level wind assembly at a desired position along said guide frame element.

5. A reel according to claim 1, wherein said groove further comprises a generally radially-inwardly extending notch at an intersection of each of said discrete segments.

6. A reel according to claim 5, wherein each of said notches is radially spaced a different distance from an axis of rotation of said drum.

7. A reel having an adjustable deployment angle, comprising:

a frame;

a drum mounted in said frame and having a core and end flanges;

a level wind assembly having a carriage, a lead screw, and a plurality of indexing fingers; and a plurality of guide frame elements, wherein at least one guide frame element is coupled to said frame proximate one end flange and at least a second guide frame element is coupled to said frame proximate a second end flange;

wherein each of said guide frame elements includes a groove having a plurality of discrete segments and notches between said discrete segments that are configured to receive said indexing fingers;

wherein each of said guide frame elements further includes a plurality of discrete flanges substantially aligned with said discrete segments of said groove; and wherein a pair of said guide frame elements are substantially mirror images of one another.

8. A reel according to claim 7, wherein, for each of said guide frame elements, each of said notches is radially spaced a different distance from an axis of rotation of said drum.

9. A reel according to claim 7, wherein said level wind assembly includes a plurality of first openings and at least one of said discrete flanges includes a plurality of second openings, wherein said plurality of first openings align with said plurality of second openings, and further wherein, when aligned, said first openings and said second openings are configured to receive fasteners to secure said level wind assembly to said guide frame element.

10. A reel according to claim 7, wherein each groove comprises between about 3 and about 10 discrete segments.

11. A reel according to claim 7, wherein each groove comprises between about 5 and about 7 discrete segments.

12. A reel according to claim 7, further including at least one discrete flange not substantially aligned with a discrete segment of said groove.

13. A reel according to claim 7, wherein each of said indexing fingers moves out of a notch, away from an axis of rotation of said drum, along one or more discrete segments, and into another notch, toward said axis of rotation of said drum to adjust said deployment angle.

14. A guide frame element coupleable to a frame for adjusting a deployment angle, comprising:

a generally planar plate;

a groove extending at least partially through said plate, said groove comprising a series of discrete segments joined end to end, said discrete segments angled with respect to one another;

a plurality of notches generally co-planar with said groove, each notch extending generally radially inwardly between a respective pair of discrete segments; and a plurality of discrete flanges, each flange substantially aligned with a respective discrete segment of said groove.

15. A guide frame element according to claim 14, wherein each flange substantially spans a distance between a respective pair of notches.

16. A guide frame element according to claim 14, wherein said discrete segments and discrete flanges are substantially linear.

17. A guide frame element according to claim 14, wherein said discrete flanges are disposed on a same side of said plate as an entrance to said groove.

18. A guide frame element according to claim 14, wherein said discrete flanges are disposed proximate a radially inward groove edge.

19. A guide frame element according to claim 14, wherein a radially outward groove edge is substantially uninterrupted.

20. A guide frame element according to claim 14, further comprising:

at least one additional flange not substantially aligned with a respective discrete groove segment.

* * * * *